US006796064B2

(12) United States Patent
Gibson et al.

(10) Patent No.: US 6,796,064 B2
(45) Date of Patent: Sep. 28, 2004

(54) DISPLAY

(76) Inventors: Scott S. Gibson, 6901 93rd Ave. SE., Mercer Island, WA (US) 98040; Spec Fulmer, 23636 60th S. Apt. C101, Kent, WA (US) 98032

( * ) Notice: Subject to any disclaimer, the term of this patent is extended or adjusted under 35 U.S.C. 154(b) by 0 days.

(21) Appl. No.: 10/360,674

(22) Filed: Feb. 7, 2003

(65) Prior Publication Data

US 2004/0154202 A1 Aug. 12, 2004

(51) Int. Cl.[7] ..... G09F 15/00

(52) U.S. Cl. ..... 40/606.15; 40/606.18; 40/611.06; 40/611.08

(58) Field of Search ..... 40/606.15, 649, 40/658, 606.01, 606.18, 607.1, 611.06, 611.12, 611.08, 606.08

(56) References Cited

U.S. PATENT DOCUMENTS 5,215,285 A * 6/1993 Lewis ..... 40/606.15
5,718,072 A * 2/1998 Garfinkle ..... 40/606.15
5,799,428 A * 9/1998 Poindexter ..... 40/611.12
5,803,420 A * 9/1998 Conway et al. ..... 40/606.15
6,318,684 B1 * 11/2001 Ireland et al. ..... 40/606.15
6,378,818 B1 * 4/2002 Padiak et al. ..... 40/606.15
6,474,009 B2 * 11/2002 Hahn ..... 40/649

* cited by examiner

*Primary Examiner*—Gary C. Hoge
(74) *Attorney, Agent, or Firm*—Delbert J. Barnard; Barnard Loop McCormack LLP

(57) ABSTRACT

An elongated tubular support (10) is mounted in a stationary position (FIGS. 6 and 7) for rotation about a horizontal (FIGS. 1 and 2) or vertical (FIG. 5) axis. A spring biased detent (66, 70, 72) is positioned between the support member (10) and a stationary mounting member (68). The detent (66, 70, 72) permits the display panel (DP) to be swung in position about a first position (FIG. 1) and a second position in which it is positioned about 180 degrees from the first position (FIG. 2).

19 Claims, 7 Drawing Sheets

26
34
30
10
38
46
48
50
36
66
64
58
72
70
68
24
28
32
78
76
74
60
58

74
32
68
80
26
50
62
58
60
66
64
48
54
46
10
56
52
DP

DISPLAY

TECHNICAL FIELD

This invention relates to displays composed of a support structure and a display panel that is supported by the support structure. More particularly, it relates to the provision of a display panel that is supported at one of its edges such that it normally extends vertically from a tubular mounting frame member. The invention also relates to making the tubular frame member rotatable between two positions so that it will support the display panel for rotation between two positions.

BACKGROUND OF THE INVENTION

U.S. Pat. No. 5,419,134, granted May 30, 1995, to Scott S. Gibson, and the other patents cited in column 1 of that patent show various types of sign boards that are adapted to be mounted in a vertical orientation.

There is a need for a display composed of a display panel that is supported at one edge for pivotal movement between a display position and a second position. There is also a need for such a display in which the display board is held in each position until it is desired to move it to its other position, and which is easily and quickly moveable from each position to the other position. There is also a need for a display that is quite simple in construction and is basically characterized by a display panel and a tubular frame member that extends along one edge of the display panel. An object of the present invention is to provide display holders that fill these needs.

BRIEF SUMMARY OF THE INVENTION

The display of the present invention is basically characterized by an elongated tubular frame member that includes a sidewall. A pair of parallel, laterally spaced apart flanges project from the side wall and define a panel-edge receiving space between them. The frame member is connected to a support structure. A display panel is provided that has an inner edge portion that is supported by the tubular frame member and is snugly received within the panel-edge receiving space, said display panel projecting outwardly from said tubular frame member.

According to an aspect of the invention, the sidewall of the tubular frame member may include a wall portion extending between the spaced apart flanges, providing a bottom for the panel-edge space. Preferably, the elongated tubular frame member has first and second ends and a center opening extending through it from the first end to the second end. The support structure includes a first insert extending into the center opening at the first end of the tubular frame member. It also includes a second insert extending into the center opening at the second end of the tubular frame member. One of the inserts may include an inner portion that is fixed relative to the tubular frame member and an outer end portion that is rotatable and movable axially in and in relation to the tubular frame member. A lug and a socket are provided, one on an outer portion of the insert and the other on the support structure endwise outwardly of the insert. A spring is located in the tubular frame member and is positioned to bias the outer portion of the insert towards the support structure and the lug into the socket. As a result, the lug and socket and spring form a detent that hold the tubular frame member against rotation relative to the support structure.

In preferred form, the lug and the socket have complementary cam surfaces which function to cam the lug out from the socket in response to a rotational movement applied to the tubular frame member. As a result, the tubular frame member and the display panel will rotate relative to the support structure when the lug is out of the socket.

According to another aspect of the invention, the display panel has an outer edge portion and the display further comprises an end cap that includes a pair of parallel, laterally spaced apart longitudinal flanges which define a panel-edge receiving space between them. The outer edge portion of the display panel is received in this space. The tubular frame member and the edge cap may have confronting channels on one or both sides of the display panel, for receiving and retaining edge portions of a second display sheet.

In one embodiment, the support structure supports the elongated tubular frame member in a substantially horizontal position and the display panel projects upwardly from the elongated tubular frame member. In one embodiment, the elongated tubular frame member is rotatable relative to the support structure, between a down position in which the display panel extends downwardly from the elongated tubular frame member and an up position. The tubular frame member and the display panel are swung upwardly from the down position and the display panel extends generally upwardly from the tubular frame member. This embodiment may include a detent that is adapted to hold the tubular frame member and the display panel in the up position. Such detent is releasable by applying a downward rotational force on a display panel for moving it towards the down position.

In another embodiment, the support structure holds the elongated tubular frame member in a substantially vertical position and the display panel extends laterally outwardly from the tubular frame member. In this embodiment, the tubular frame member is rotatable in a position about a vertical axis between a first position and a second position. A detent may be provided for holding the tubular frame member in the first position. This detent is releasable by a rotational force applied to the display panel for moving it towards the second position.

Another embodiment of the invention includes a barrel nut or the like inside the tubular support structure. A tubular stem has an end portion that is in contact with the tubular frame member diametrically opposite the spaced apart flanges. A bolt extends through the stem and makes threaded engagement with the barrel nut, so as to connect the tubular support structure to the tubular stem.

Other object, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWING

Like reference numerals are used to designate like parts throughout the several views of the drawing, and.

DETAILED DESCRIPTION OF THE INVENTION

Figure 1:
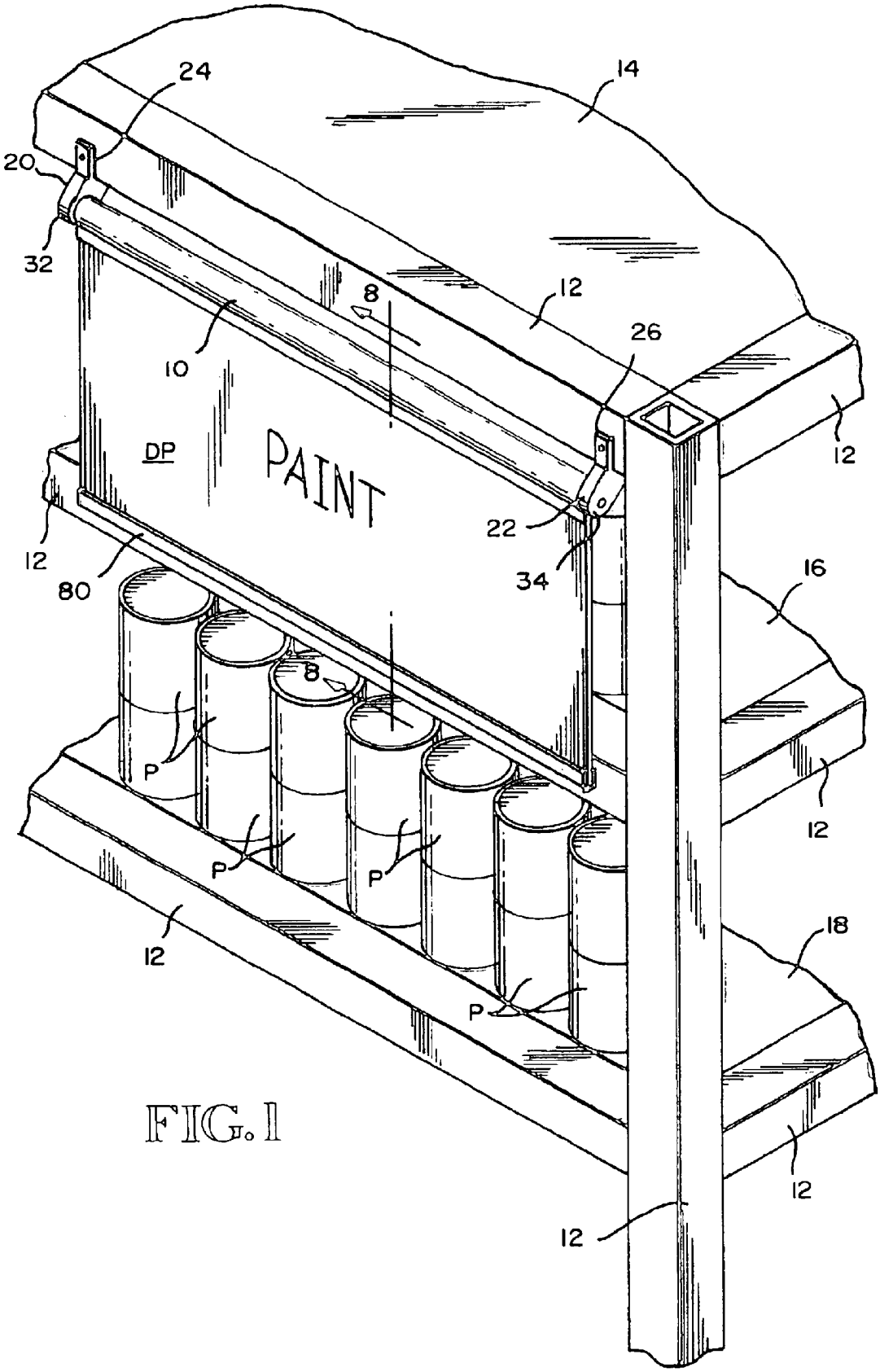
FIG. 1 is a fragmentary pictorial view of shelving and a display panel mounted on an upper portion of the shelving, and shown in a display position in front of a shelf space.
Figure 2:
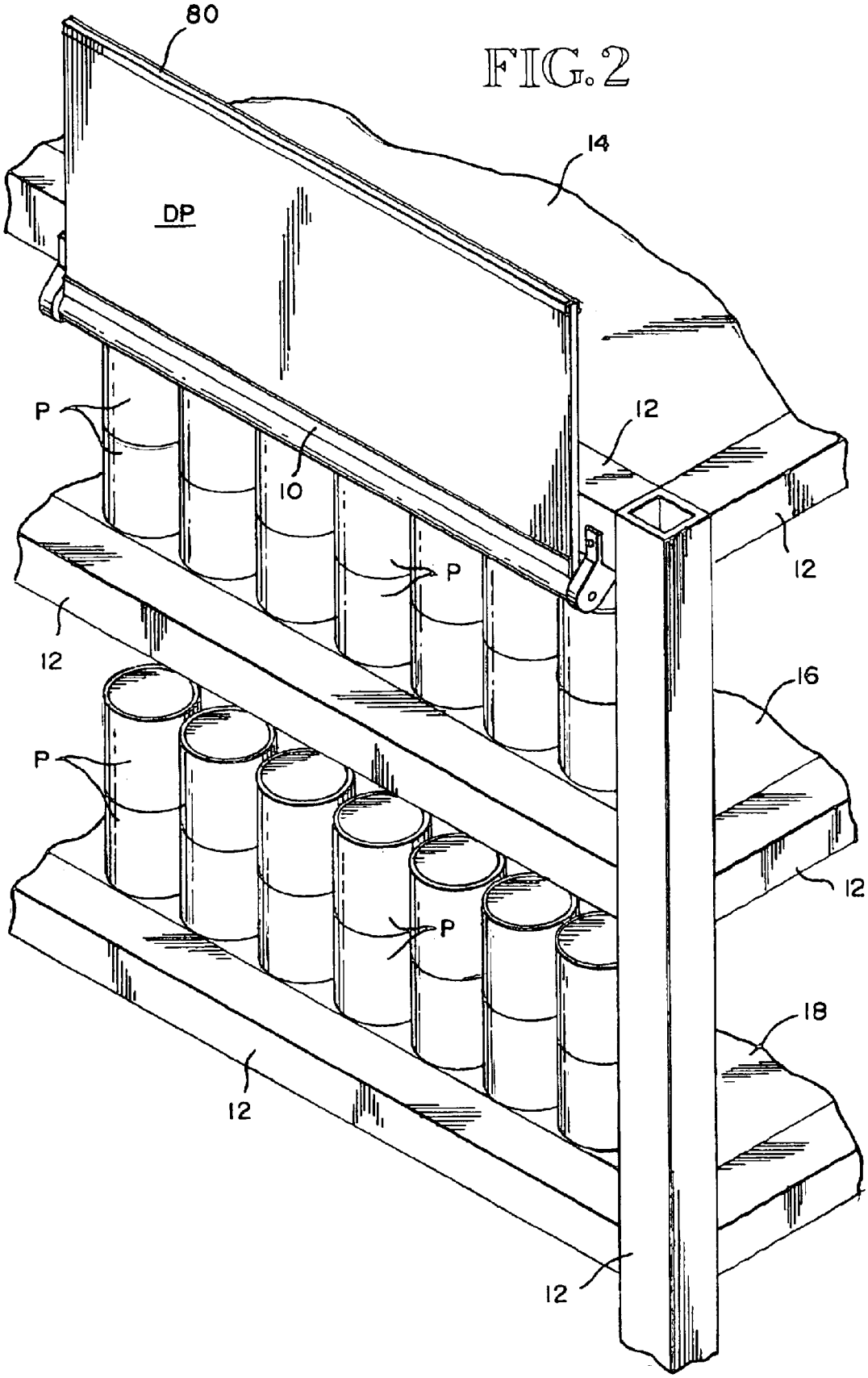
FIG. 2 is a view like FIG. 1 but showing the display panel swung upwardly into a position above the entrance to the shelf space.

FIGS. 1 and 2 show the preferred embodiment of the invention. It includes a display panel DP and an elongated tubular frame member 10 and a support structure that mounts the tubular frame member 10 onto a shelving frame member 12, for rotational movement about a horizontal axis. Frame member 12 is a part of framing for shelving such as is used for holding and displaying merchandise in a store. The frame is composed of horizontal and vertical frame members 12. The shelving shown in FIGS. 1 and 2 has a top shelf 14, a second shelf 16 immediately below shelf 14 and a third shelf 18 immediately below shelf 16. Additional shelves are provided below shelf 18 but it is not necessary to show them in order to describe the invention.

In the examples shown by FIGS. 1 and 2, the merchandise on the shelves 16, 18 are cans of paint, some of which are designated P. In this embodiment, the support structure for the tubular frame member 10 includes a pair of mounting brackets 20, 22, one at each end of the tubular frame member 10. The mounting brackets 20, 22 include vertical mounting arms 24, 26 and horizontal mounting arms 28, 30 (FIG. 3A) that are below frame member 12. They also include lugs 32, 34 that receive and support the end portions of the tubular frame member 10. The support structure for the tubular frame member 10 also includes a pair of inserts, one for each end of the tubular frame member.

The tubular frame member 10 has first and second ends and a center opening extending through it from the first end to the second end. A first insert extends into the center opening at the first end of the tubular frame member 10. A second insert extends into the center opening at the second end of the tubular frame member 10. One of these inserts will now be described with reference to FIGS. 3, 3*a*, 4 and 14, in particular. This insert is designated 36 in FIG. 3*a*. The second insert at the second end of the tubular frame member 10 may be identical in construction to insert 36 and so it need not be, and is not, separately described.

Figures 3, 3A, 4:
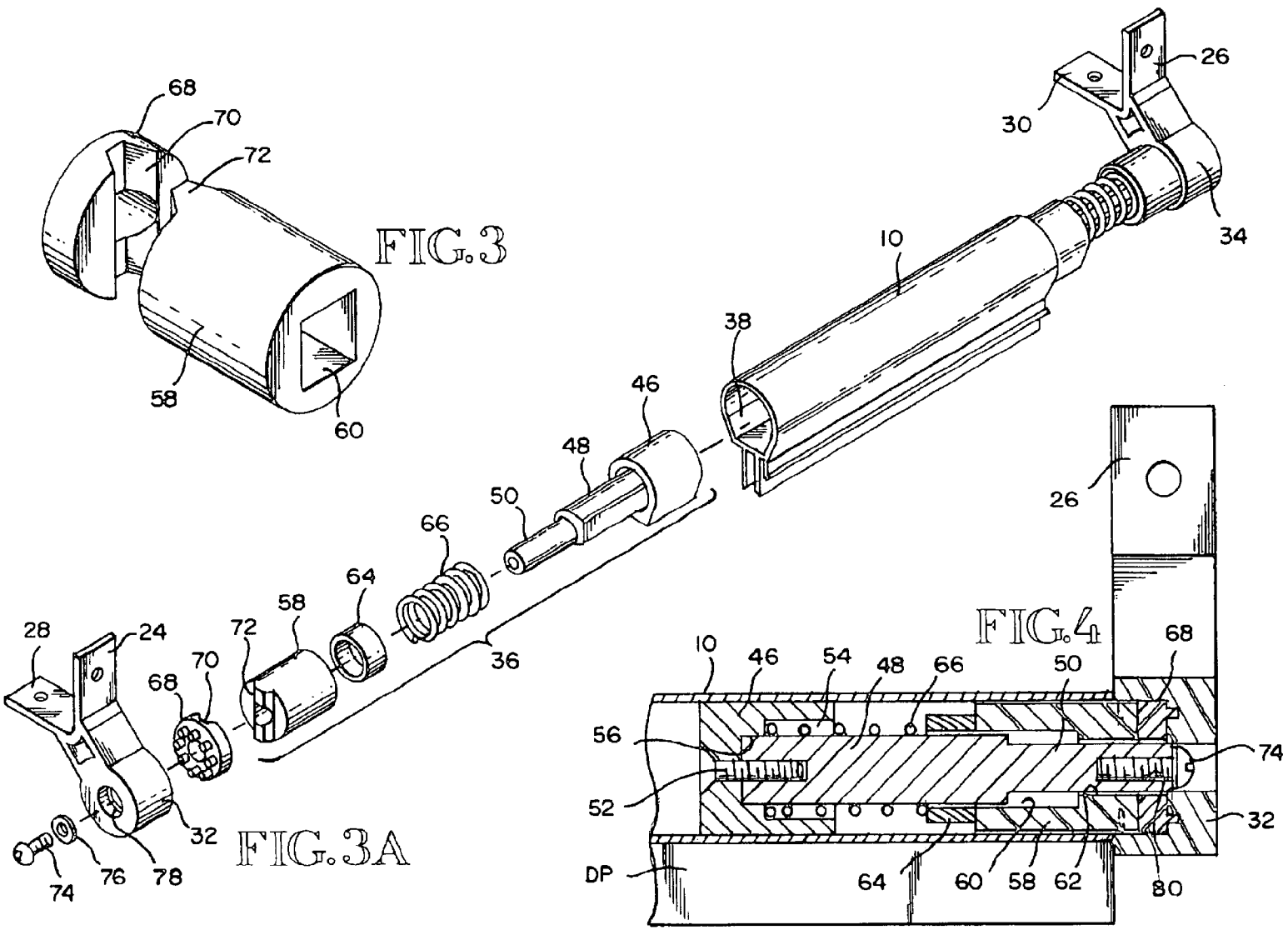
FIG. 3 is an exploded pictorial view of a socket member that includes a socket and a lug member that includes a lug that fits into the socket.
FIG. 3A is an exploded pictorial view of a mounting assembly of which the lug and socket members are a part.
FIG. 4 is a longitudinal sectional view of the lug and socket members and of supporting structure that includes a spring that biases the lug member toward the socket member and the lug into the socket.
Figure 14:
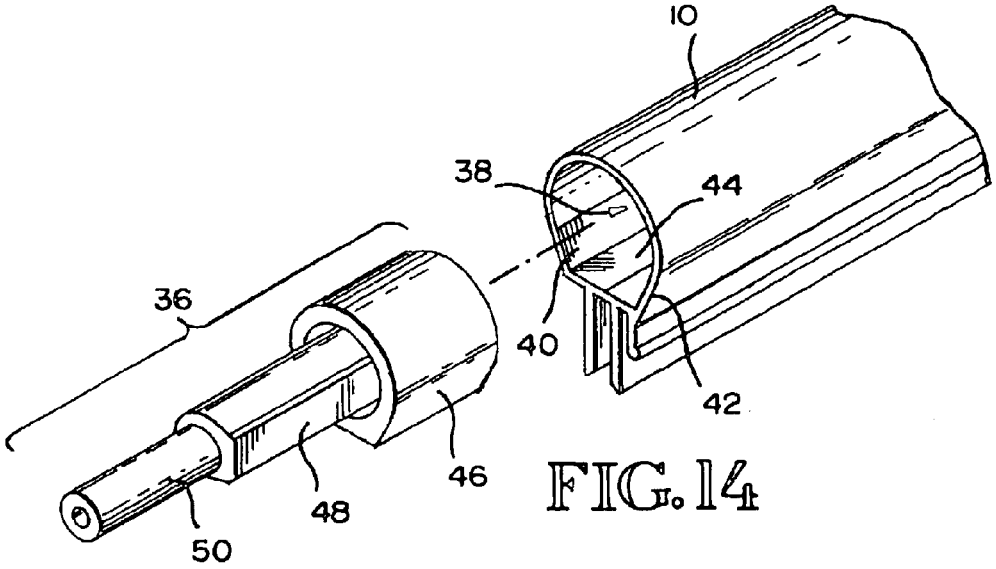
FIG. 14 is an enlarged scale view of the central portion of FIG. 3A, showing the shape of the opening that extends through the tubular support member and the inner end portion of an insert that fits into the center opening.

As best shown by FIG. 14, the tubular frame member 10 has a non-circular center opening 38. The upper part of the sidewall of tubular frame member 10, as illustrated in FIG. 14, may be substantially semi-cylindrical in shape. It may have lower side portions 40, 42 that are substantially flat and converge as they extend downwardly from the curved upper portion to a flat bottom wall 44. The insert 36 may have an inner end portion 46 that also has a non-circular cross-sectional shape that is sized to rather snugly fit within the opening 38. As a result, when member 46 is within opening 38, it will not rotate in position relative to the tubular frame member 10. And, the tubular frame member 10 will not rotate in position relative to it. An elongated shank is connected to inner end member 46, such as by a screw 52 as shown in FIG. 4. Member 46 includes a first socket 54 that is directed endwise outwardly from member 46 in a smaller dimension second socket 56 which is non circular in cross-section, e.g. a square shape.

Shaft portion 48 has a cross-sectional shape and at its inner end it fits snugly within the socket 56. The insert 36 includes an outer end member 58 that is circular in cross-section so that it can rotate inside of the opening 38. It includes a center opening having a first portion 60 with a cross-sectional shape substantially equal to shaft portion 48. It also includes a second portion 62 that is circular in cross-section and is slightly larger in diameter than shaft portion 50. A cylindrical ring 64 surrounds shaft portion 48 and provides an end abatement for a compression spring 66. The opposite end of spring 66 extends into socket 54 and contacts a shoulder that is formed where socket 54 meets socket 56. Shaft portion 50 projects endwise outwardly from tubular frame member 10 through the opening 62 and then through a center opening in a ring 68.

Referring to FIGS. 3, 3A and 4, and FIG. 4 in particular, the member 68 includes pins that are receivable in sockets formed in member 32. When the pins are in the sockets, the member 68 is held against rotation relative to the member 32. As shown by FIGS. 3 and 3A, the side of member 68 that is opposite the pins includes a transverse socket 70 that confronts a transverse lug on member 58. Screw 52 secures the inner end member 46 to the inner end of shaft portion 48. A screw 74 extends through a washer 76 and then through an opening 78 in member 32. Screw 74 has threads that screw into a threaded socket 80 and the shaft portion 50. The head of the screw 74 bears against the base of the opening 78. When the screw 74 is tightened, its threads move relatively into the threaded socket 80 and pull the outer end of the shaft portion 50 into contact with the interface of member 32. In this manner, shaft portions 48, 50 are secured to member 32 as is member 46 that is secured to shaft portion 48 by the screw 52. The spring 66 has an inner end that is situated in the socket 54. Its outer end contacts ring 64 which in turn contacts outer end member 58. The spring 66 normally biases the ring 64 and the member 58 into the position shown by FIG. 4. When in this position, the lug 72 is situated within the socket 70.

The members 46, 48, 50 are rotatable in position relative to the members 58 and 32. The side surfaces of the lug 72 and the corresponding side surfaces of the socket 70 are sloped. As a result, when a rotational force is applied to the display panel DP and in turn the members 10, 46, 48, 50, these members will rotate in position. The rotational forces applied on inner end member 58 will cause the sloping surfaces of the socket 70 and lug 72 to cam the lug 72 out from the socket 70. As this happens, the member 58 is moved against the compression of spring 66. When the members DP, 46, 48, 50 are rotated about 180 degrees, the lug 72 will be moved by the spring 66 back into the socket 70, this time in an upside down position from the original position.

FIG. 1 shows the display panel DP in a vertical position, depending from the support member 10. In this position the display panel DP is in front of the shelf 16 and the paint cans P or other items on the shelf 16. The lug 72 and socket 70 will hold the display panel DP in this position. However, when a person wants to gain access to the shelf 16, all he/she has to do is to grab the display panel DP and pull upwardly on its lower edge. This causes rotation of the display panel DP and the support member 10 about a horizontal axis. As previously described, it also causes the member 58 to be moved away from the member 68, and the lug 72 to be moved out from the socket 70. After a few degrees of rotation, the lug 72 will contact the face portions of the member 68 that bound the socket 70. At this time, the display panel DP will be easily rotatable about its axis. When it is rotated or swung into the position shown by FIG. 2, the display panel DP extends vertically upwardly from support member 10. When in this position, the display panel DP is 180 degrees removed from its position shown by FIG. 1. In this new position, shown by FIG. 2, the lug 72 will re-enter the socket 70. The spring 62 will again expand and will tend to hold the lug 72 into engagement with the socket 70. Thus, the display panel DP will stay in the "up" position shown in FIG. 2 until it is grasped and rotated back to its "down" position shown in FIG. 1.

The socket 70, the lug 72 and the spring 66 act together to form a "detent" for releasably securing the display panel DP in position relative to the shelving 12, 14, 16, 18.

Figure 5:
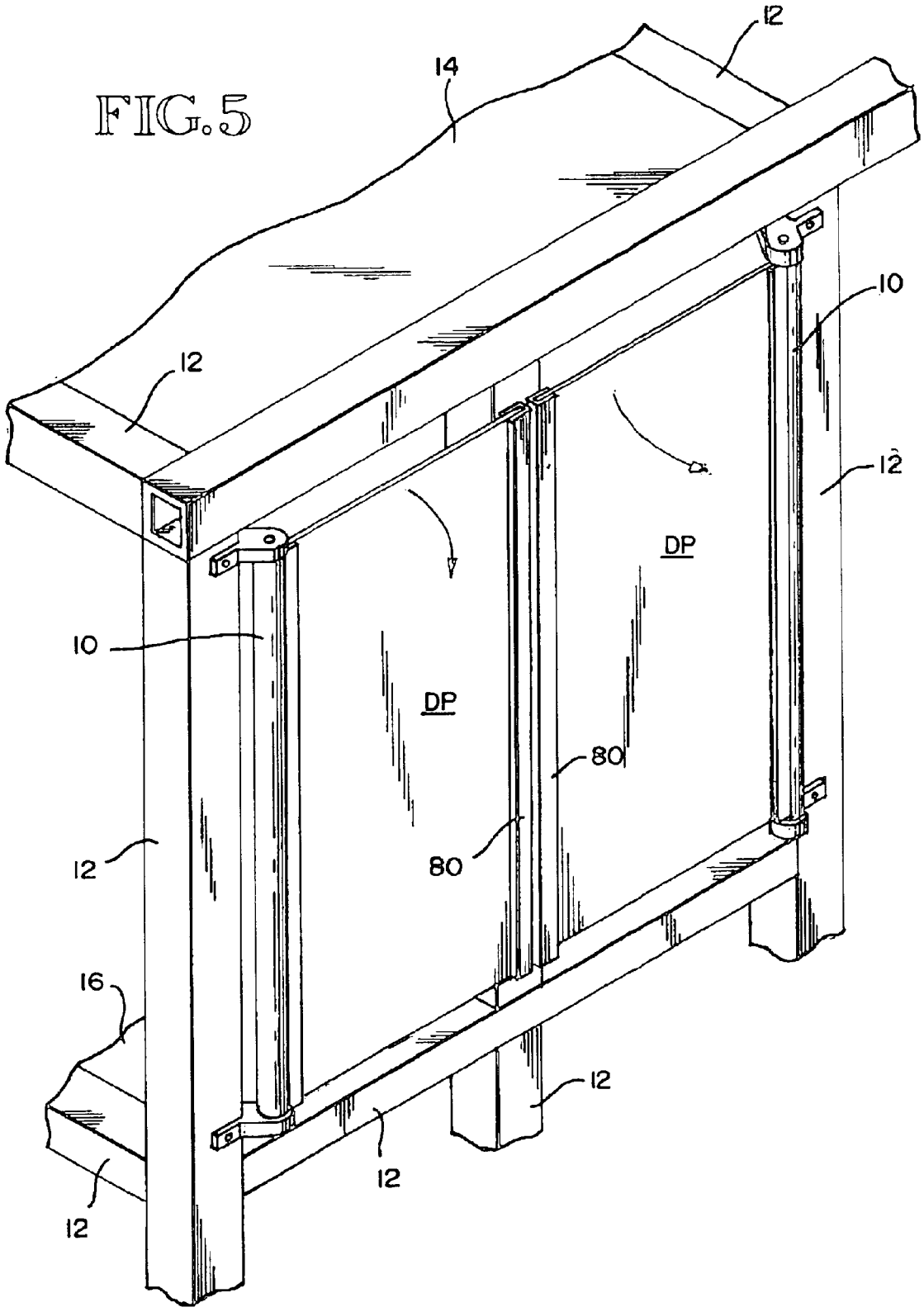
FIG. 5 is a pictorial view of a modified display comprising two display panels side-by-side, mounted for pivotal movement about vertical axes, between shelf-space opening and shelf-space closing positions.

The embodiment shown by FIG. 5 includes two display panels DP that are in the nature of doors for a storage space below shelf 14 and above shelf 16. The support members 10 are oriented for pivotal movement or rotation about a vertical axis. In other respects, they and the other structures shown in FIGS. 3, 3A and 4 are the same. FIG. 5 shows the display panels DP in a closed position. In this position they close the space that is inwardly of them and below shelf 14 and above shelf 16. The display panels DP are rotatable from the position shown by FIG. 5 180 degrees until they are in a position in which they extend outwardly rather than inwardly from the members 10. In both positions, the display panels DP are in coplanar parallelism. The above-described detent structure allows a person to grasp one or both of the display panels DP and pull on it to cause it to rotate about its vertical axis, and then be held in position when it or they are in the position shown by FIG. 5, or in the position that is 180 degrees from the position shown by FIG. 5. The detent structure operates the same way that it did in connection with the first embodiment. The only difference is that rotation is about a vertical axis rather than about a horizontal axis.

Figure 8:
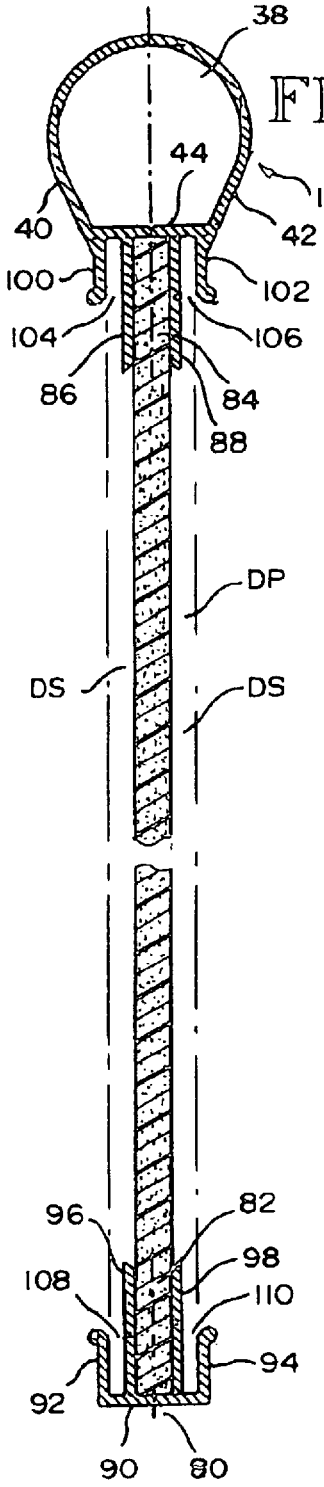
FIG. 8 is a sectional view substantially along line 8—8 of FIG. 1.

In preferred form, the display panel DP is provided with an end cap 80 that is secured to the panel edge 82 that is opposite panel edge 84. Referring to FIG. 8, the member Lo has a pair of flanges 86, 88 that extend away from the sidewall 44. These flanges 86, 88 define a panel-edge receiving space, slot or channel (herein "channel"). As shown by FIG. 8, an edge portion 84 of the display panel DP is received in the socket. An adhesive may be used for securing it in the socket. Or, a mechanical fastener may be used for connecting one or both of the flanges 86, 88 to the edge portion of the display panel DP. In like fashion, the edge cap 80 has an end wall 90, a pair of sidewalls 92, 94 that connect to the endwall 90 and extend away from it in spaced apart parallelism. A pair of flanges 96, 98 also extend away from end wall 90 and define between them a socket for receiving the end edge portion 82 of the display panel DP. At this location, an adhesive or a mechanical fastener may be used for securing the cap 80 to the display panel DP.

In the embodiment shown by FIG. 8, a second pair of flanges 100, 102 extend away from wall 44 on opposite sides of the flanges 86, 88. Flanges 100, 102 are substantially parallel to flanges 86, 88. They are spaced away from the flanges 86, 88 so that a pair of channels 104, 106 are formed outwardly of each flange 86, 88. In like fashion, the sidewalls 92, 94 on the end cap 80 are substantially parallel to and spaced outwardly from the flanges 96, 98. They define a pair of sockets 108, 110 that are positioned outwardly adjacent the flanges 96, 98.

As should be evident, the sockets 104, 106, 108, 110 are provided to receive edge portions of display sheets DS. Referring to FIG. 8, a first display sheet DS may be placed on the left side of the display panel DP (as drawn) and it may have upper or lower edge portions that fit within the channels 104, 108. In similar fashion, a second display sheet DS is positioned on the right side of the display panel DP (as illustrated). It has upper and lower edge portions that are received within the channels 106, 110.

Figure 9:
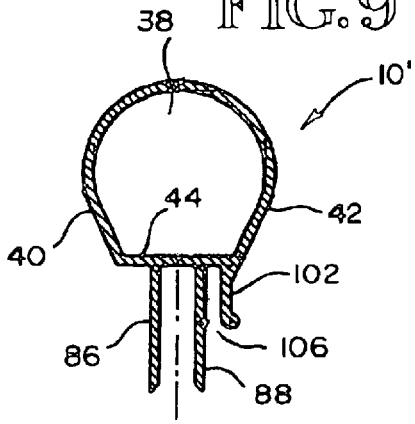
FIG. 9 is a sectional view of a support frame member that is provided with a single display sheet channel.

FIG. 9 shows a modified embodiment of the support member 10'. It is like the support member 10 except that it only includes the second flange 102 on one of its sides, thus forming only the channel 106 for receiving an edge portion of a display sheet DS. The end cap for use with support member 10' would be like the end cap shown by FIG. 8 but with the sidewall or flange 92 and the position of the wall 90 that is outwardly of flange 96 removed.

Figure 10:
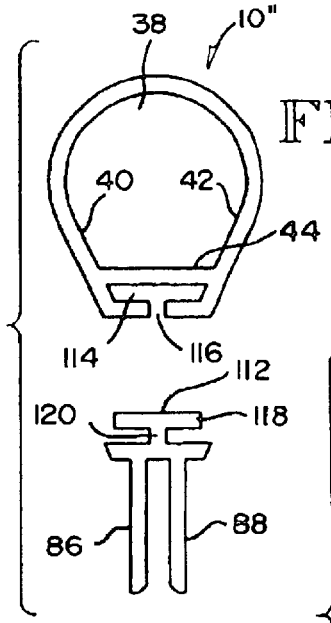
FIG. 10 is an end view showing a two-part construction of the support frame member.
Figure 11:
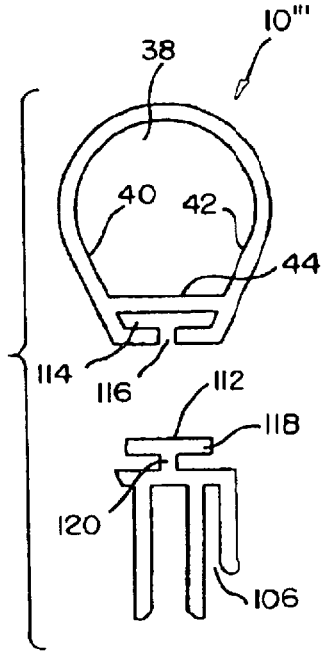
FIG. 11 is a view like FIG. 10 but showing a support sheet receiving channel on one side of the display panel receiving channel.

FIGS. 10 and 11 show a sectional construction of the member 10", 10'". In this construction, the flanges 86, 88 are connected to a base structure 112 that is detachably connected from the portion of the member 10", 10'" that includes the wall 44. Outwardly of the wall 44, there may be a slot 114 that is parallel to wall 44 and a gap 116 that is perpendicular to slot 114 and wall 44. The end portion 112 of the member that includes the flanges 86, 88 is slideable into connection with the structure that bounds the slot 114 and the gap 116. The structure 112 may include a first strip 118 that is sized to fit within the slot 114 and a second strip or stem 120 that is sized to fit within the gap 116.

The embodiment of FIG. 10 does not include sockets for edge portions of display sheets DS. The embodiment of FIG. 11 shows only the socket 106. A third embodiment may have both sockets 104, 106.

Figure 12:
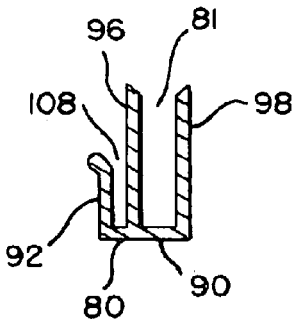
FIG. 12 is a sectional view of the lower portion of FIG. 8, but showing a single display sheet receiving channel on the edgecap.
Figure 13:
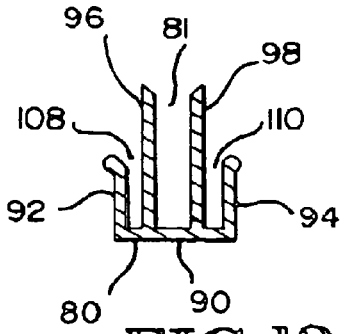
FIG. 13 is a view like FIG. 12 but showing two display sheet channels, one on each side of the channel that receives the edge portion of the display panel.

FIG. 12 shows an end cap for an embodiment that includes only one display sheet socket 108. FIG. 13 shows the end cap 80 that is shown in FIG. 8. In FIGS. 12 and 13 the socket for the edge portion 82 of the display panel DP is designated 81.

Figure 7:
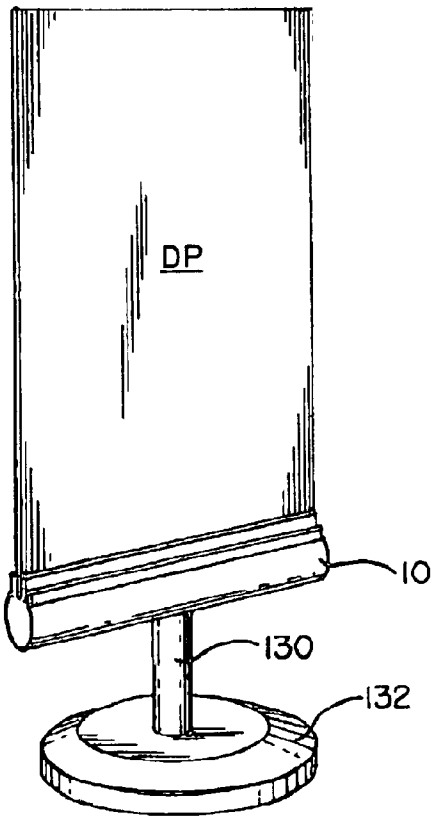
FIG. 7 is a pictorial view of a fourth embodiment of the invention, showing the support member mounted on top of a post and a display panel extending upwardly from the support member.

FIG. 7 shows an embodiment of the invention in which the tubular support member 10 extends horizontally and is secured to the upper end of a tubular stem 130. The lower end of stem 130 is connected to a mounting base 132. The mounting structure 10 may be like any one of the mounting structures that are described above. In this embodiment, the display panel DP is supported only at its lower edge. There is no end cap or any other structure provided on any of its remaining three edges. The display panel DP in this embodiment, as in the earlier embodiments, may be a flat panel of foam board.

Figure 6:
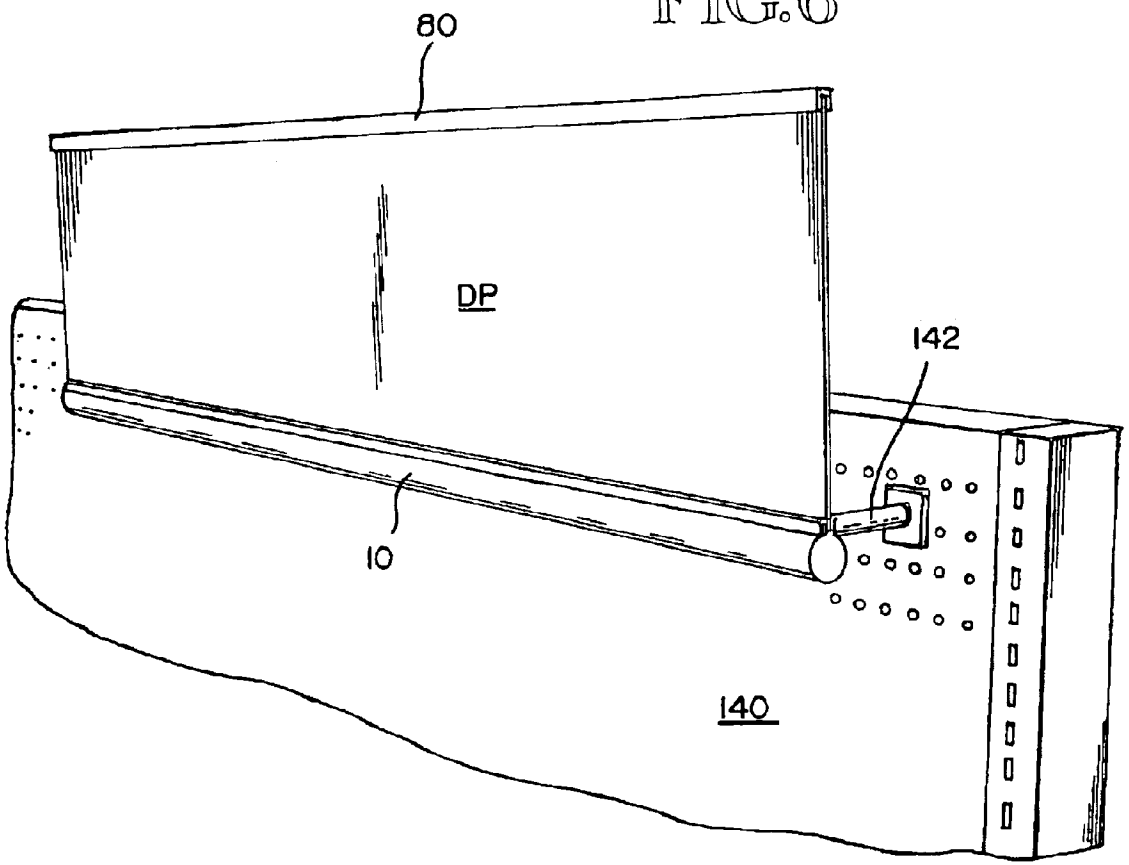
FIG. 6 is a pictorial view of a third embodiment of the invention, comprising an elongated support frame member mounted onto a support structure and a display panel extending upwardly from the frame member.
Figure 15:
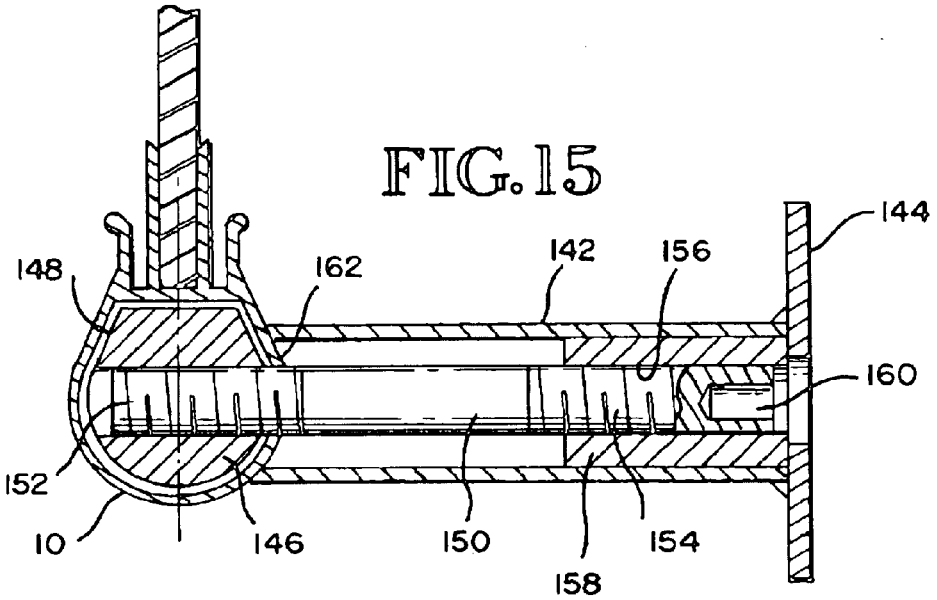
FIG. 15 is a fragmentary sectional view of the base portion of FIG. 6, showing a barrel nut inside the tubular support member, a mounting tube extending from a mounting plate to a side of the tubular support member, and a bolt inside of the mounting tube connecting a nut inside of the mounting tube with the barrel nut inside of the tubular frame member.

In the embodiment of FIG. 6, the tubular support member 10 extends horizontally and the display panel DP extends upwardly from the member 10. A cap 80 is provided on the upper edge of the display panel DP. Member 10 may be like any of the previously described tubular support members. The cap 80 may be like any of the previously described caps. In this embodiment, the tubular support member 10 is connected to a wall 140 by a plurality of horizontal stems, one of which is designated 142. Referring to FIG. 15, the stem 142 is a tubular member that is connected at one end to a mounting base 144. The opposite end is sculptured to fit against the side surface of the member 10. At the location of each stem 142, there is an insert 146 in the tubular member 10. It may have a cross-sectional configuration like member 46 shown in FIG. 3A. This particular insert 146 has a lateral opening 148 that is internally threaded. A bolt or stud 150 extends axially through the stem 142. Its end 152 is threaded and screws into the threaded opening 148. The opposite end 154 is also threaded. It screws into a threaded opening 156 in a member 158 that is secured to the stem sidewall and/or the base 144. In FIG. 15, the base end of member 150 includes an allen wrench receiving socket 160. In this embodiment, the insert 146 is placed within the tubular member 10, with its opening 148 aligned with a sidewall opening 162 in the member 10. Bolt or stud 150 is then inserted through the base 144 and is first screwed into the ember 158 and is then screwed into the member 146. Ah alien wrench (not shown) is inserted the wrench socket 160 and used for rotating the bolt 150. The bolt 150 is tightened until the outer end of the stem 152 is moved tightly against the outer side surface of the tubular member 10. Several of these stem assemblies are connected to the tubular member 10 and are spaced apart along its length. The bases 144 are in some manner connected to the wall 140 or some other support structure. The stems 142 extend horizontally. The display panel DP extends upwardly from the tubular member 10.

In the embodiment shown by FIG. 7, the stem 130 and the display panel DP both extend vertically. The stem 130 may be connected to the tubular support member and the base 132 in the manner shown by FIG. 15.

In all of the embodiments, the display panel DP may be merely a rectangular handle portion of a foam board material or the like. That is, it is supported only where it is joined to the tubular structure 10. The other three edges are cut edges. The display information may be printed directly on the display panel DP. Or, it may be printed on a display sheet DS that is either glued to the display panel DP in some manner, or is removably mounted on the display panel DP by use of the display sheet channels 104, 106, 108, 110. In some embodiments, it may be desirable to provide the display panel DP with one of the end caps 80 or some other form of end cap.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather are to be determined by the following claims, interpreted according to accepted doctrines of patent claim interpretation, including use of the doctrine of equivalents and reversal of parts.

What is claimed is:

1. A display, comprising:

an elongated tubular frame member including a side wall;

a pair of parallel, laterally spaced apart flanges projecting from said side wall and defining a panel-edge receiving space between them;

support structure to which said frame member is connected;

a display panel having an inner edge portion that is supported by the tubular frame member and is snugly received within the panel-edge receiving space, said display panel projecting outwardly from said tubular frame member; and wherein the side wall of the tubular frame member includes a wall portion extending between the spaced apart flanges, providing a bottom for said panel-edge space.

2. The display of claim 1, wherein said elongated tubular frame member has first and second ends and a center opening extending through it from the first end to the second end, and said support structure includes a first insert extending into the center opening at the first end of the tubular frame member and a second insert extending into the center opening at the second end of the tubular frame member.

3. The display of claim 2, wherein a said insert includes an inner portion that is fixed relative to the tubular frame member and an outer end portion that is rotatable with and movable axially in and relative to the tubular frame member, and a lug and a socket, one on an outer portion of the insert and the other connected to the support structure endwise outwardly of the insert, and a spring in said tubular frame member positioned to bias the outer portion of the insert towards the support structure and the lug into the socket, whereby said lug and socket and spring form a detent that holds said tubular frame member against rotation relative to the support structure.

4. The display of claim 3, wherein the lug and the socket have complementary cam surfaces which function to cam the lug out from the socket in response to a rotational movement applied to the tubular frame member, whereby the tubular frame member and the display panel will rotate relative to the support structure when the lug is out of the socket.

5. The display of claim 1, wherein the display panel has an outer edge portion and the display further comprises an endcap including a pair of parallel, laterally spaced apart longitudinal flanges which define a panel-edge receiving space between them in which the outer edge portion of the display panel is received.

6. The display of claim 5, wherein the tubular frame member and the endcap have confronting channels on one side of the display panel for receiving and retaining edge portions of a display sheet.

7. The display of claim 6, wherein the tubular frame member and the endcap also have confronting channels on the second side of the display panel for receiving and retaining edge portions of a second display sheet.

8. The display of claim 1, wherein the support structure supports the elongated tubular frame member in a substantially horizontal position.

9. The display of claim 8, wherein the display panel projects upwardly from the elongated tubular frame member.

10. The display of claim 9, wherein the sidewall of the tubular frame member includes a wall portion extending between the spaced apart flanges, providing a bottom for said panel edge space.

11. The display of claim 10, wherein the display panel has an outer edge portion and the display further comprises an endcap including a pair of parallel, laterally spaced apart longitudinal flanges which define a panel-edge-receiving space between them in which the outer edge portion of the display panel is received.

12. The display of claim 11, wherein the tubular frame member and the endcap have confronting channels on one side of the display panel for receiving and retaining edge portions of a display sheet.

13. The display of claim 12, wherein the tubular frame member and the endcap also have confronting channels on the second side of the display panel for receiving and retaining the edge portions of a second display sheet.

14. The display of claim 8, wherein the elongated tubular frame member is rotatable relative to the support structure, between a down position in which the display panel extends downwardly from the elongated tubular frame member and an up position in which the tubular frame member and display panel are swung upwardly from the down position and the display panel extends generally upwardly from the tubular frame member.

15. The display of claim 14, further comprising a detent adapted to hold the tubular frame member and the display panel in the up position, and releasable by applying a downward rotational force on the display panel for moving it towards the down position.

16. The display of claim 1, wherein the support structure holds the elongated tubular frame member in a substantially vertical position, and the display panel extends laterally away from the tubular frame member.

17. The display of claim 16, wherein the tubular frame member is rotatable in position about a vertical axis between a first position and a second position.

18. The display of claim 17, further comprising a detent for holding the tubular frame member in the first position, said detent being releasable by a rotation force applied to the display panel for moving it towards the second position.

19. The display of claim 1, wherein the tubular support structure includes a barrel nut inside said tubular frame member, a tubular stem having an end portion in contact with said tubular frame member diametrically opposite the spaced apart flanges, and a bolt extending through said stem and making threaded engagement with the barrel nut.

* * * * *